United States Patent [19]

Spencer

[11] 4,022,563

[45] May 10, 1977

[54] PRESSES

[75] Inventor: Robert Spencer, Stroud, England

[73] Assignee: Simon-Barron Limited, Gloucester, England

[22] Filed: Oct. 2, 1975

[21] Appl. No.: 619,010

[30] Foreign Application Priority Data

Nov. 9, 1974 United Kingdom ..... 48585/74

[52] U.S. Cl. ..... 425/331; 425/DIG. 230; 425/365

[51] Int. Cl.[2] ..... B28B 21/24

[58] Field of Search ..... 425/331, 311, 363, 365, 425/374, DIG. 230; 403/335, 336, 338, 356, 358

[56] References Cited

UNITED STATES PATENTS

| | | | |
|---|---|---|---|
| 3,010,150 | 11/1961 | Meakin | 425/331 |
| 3,108,055 | 10/1963 | Grant | 425/331 X |
| 3,382,818 | 5/1968 | Landers | 425/331 |

*Primary Examiner*—Richard B. Lazarus
*Attorney, Agent, or Firm*—Norris & Bateman

[57] ABSTRACT

A press of the kind for the preparation of pellets of cattle feed or other pelletizable material and comprising an annular die having a plurality of radial bores therein, which is mounted on a driving rim for rotation around a stationary support fitted with a number of pressure rollers, each freely rotatable on a stationary shaft and in closely spaced relationship with the interior surface of the die, the arrangement being such that material fed into the interior of the die is forced through the bores therein by the action of said pressure rollers, characterized in that the die and driving rim therefor are provided with circumferential complementary mating male and female conical surfaces, and in that screw means is provided for clamping the die to the driving rim such that said mating surfaces are brought into pressurised engagement.

9 Claims, 1 Drawing Figure

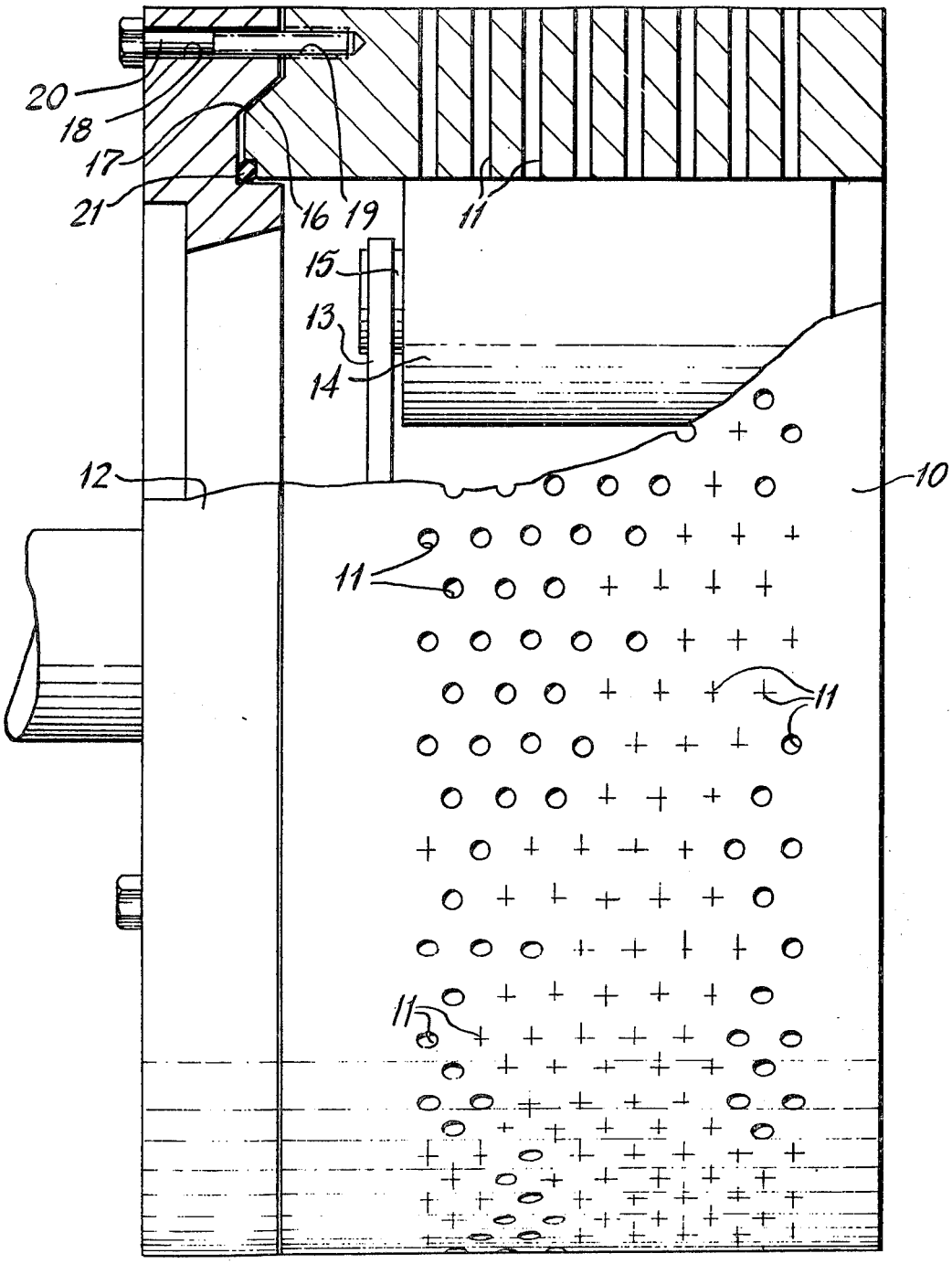
20
18
17
21
16
19
11
15
13
14
12
10
11
11
11

PRESSES

This invention concerns a press of the kind (hereinafter termed of the kind referred to) for the preparation of pellets of cattle feed or other pelletizable material and comprising an annular die having a plurality of radial bores therein, which is mounted on a driving rim for rotation around a stationary support fitted with a number of pressure rollers, each freely rotatable on a stationary shaft and in closely spaced relationship with the interior surface of the die, the arrangement being such that material fed into the interior of the die is forced through the bores therein by the action of said pressure rollers.

In conventional presses of the kind referred to, the annular die is secured to the driving rim by bolts which extend in a direction parallel with the central axis of the die or is secured by a bolted circumferential clamp.

It will thus be understood that it is necessarily a tedious and time consuming operation to remove and replace a die on the press for cleaning, maintenance or other purposes.

It is an object of the present invention to provide a press of the kind referred to wherein the means for securing the die to the driving rim therefor are such as to permit more ready removal and replacement of the die.

Thus, according to the present invention, a press of the kind referred to is characterised in that the die and driving rim therefor are provided with circumferential complementary mating male and female conical surfaces, and in that screw means is provided for clamping the die to the driving rim such that said mating surfaces are brought into pressurised engagement.

The invention will be further apparent from the following description with reference to the single FIGURE of the accompanying drawing which shows, by way of example only, a partially sectioned perspective and diagrammatic view of one form of press of the kind referred to and embodying the invention.

Referring now to the drawing, it will be seen that the press, in known manner, essentially comprises an annular die 10 having a multiplicity of radial bores 11 therethrough, and which is arranged with its central axis extending in a horizontal direction. The die 10 is secured by one of its ends to a driving rim 12 for rotation about a stationary support 13 disposed within the interior of the die 10. The stationary support 13 carries a number (usually two) of equi-angularly spaced pressure rollers 14, each freely rotatable about a stationary shaft 15 such that its periphery is closely spaced from the interior peripheral surface of the die 10.

In use, material, such as cattle feed for example, which is to be pelletized is fed to the interior of the die 10 whilst the latter is rotated. The pressure rollers 14 force such material through the bores 11 and the material extruded through the die to the outside surface thereof is severed by knife means (not shown) to form pellets of the required length.

In accordance with the invention, the die 10 and driving rim 12 are formed with complementary mating male and female frusto-conical surfaces 16 and 17 respectively. A plurality of bores 18 are provided through the driving rim 12 in an axial direction at circumferentially spaced intervals therearound, each of which can be aligned with a screw-threaded blind bore 19 in the die 10, whereby the die 10 may be clamped to the driving rim 12 by screws 20 such that the surfaces 16 and 17 are brought into pressurised engagement. A resilient ring 21 is disposed between the parts 10 and 12 to form a seal.

As shown in the drawing driving rim member 12 is annular so that coextenive conical surfaces 16 and 17 are coaxial and face axially of rim member and die members which rotate together about a central horizontal axis. The screws 20 are distributed peripherally around rim 12 and they attach the die member to the rim member as well as serving to urge frusto-conical surfaces into pressurized engagement.

It will be understood that considerable torque can be transmitted from the driving rim 12 to the die 10 by friction at the surfaces 16 and 17 and that accordingly the number of screws 20 necessary to clamp the die operatively to the driving rim need be few. We have found that three screws 20 are generally sufficient.

It will be appreciated that it is not intended to limit the invention to the above example only, many variations, such as might readily occur to one skilled in the art, being possible without departing from the scope thereof.

Thus, for example, the male conical surface may be provided on the driving rim instead of on the die.

What is claimed is:

1. A press for the pelletization of material comprising an annular die member having a plurality of radial bores therethrough, a stationary support disposed within said die member, a plurality of pressure rollers arranged in a row around the inner circumferential surface of said die member, said rollers being freely rotatable about fixed parallel axes and with the radially outer surface of each roller closely adjacent the inner surface of said die member, a driving rim member mounted for rotation about a central axis parallel to said roller axes, and means mounting said die member on said rim member comprising interfitting coextensive complementary axially oppositely facing male and female frusto-conical surfaces on said members and a plurality of fastener elements peripherally distributed about and extending through said rim member into the adjacent end of said die member for attaching said die and rim members together and urging said frusto-conical surfaces relatively axially into pressurized engagement, rotation of said rim member thereby rotating said die member about said central axis so that material fed into the interior of the die member is forced out through the die member bores by action of said pressure rollers.

2. A press according to claim 1 wherein said male frusto-conical surface is provided on the die member.

3. A press according to claim 1 wherein said male frusto-conical surface is provided on the driving rim member.

4. A press according to claim 1 wherein there are a plurality of bores extending through the driving rim member in an axial direction at circumferentially spaced intervals adapted to receive fastener screws which threadedly engage corresponding blind bores in the annular die member.

5. A press according to claim 2 wherein there are a plurality of bores extending through the driving rim member in an axial direction at circumferentially spaced intervals adapted to receive fastener screws which threadedly engage corresponding blind bores in the annular die member.

6. A press according to claim 3 wherein there are a plurality of bores extending through the driving rim member in an axial direction at circumferentially spaced intervals adapted to receive fastener screws which threadedly engage corresponding blind bores in the annular die member.

7. A press according to claim 4 wherein there is provision for three screws to connect the driving rim and annular die members.

8. A press according to claim 5 wherein there is provision for three screws to connect the driving rim and annular die members.

9. A press according to claim 6 wherein there is provision for three screws to connect the driving rim and annular die members.

* * * * *